US009960544B2

(12) United States Patent
Ho

(10) Patent No.: US 9,960,544 B2
(45) Date of Patent: May 1, 2018

(54) ELECTRICAL CONNECTION DEVICE

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days. days.

(21) Appl. No.: 15/520,035

(22) PCT Filed: Nov. 12, 2015

(86) PCT No.: PCT/IB2015/002397

§ 371 (c)(1),
(2) Date: Apr. 18, 2017

(87) PCT Pub. No.: WO2016/075548

PCT Pub. Date: May 19, 2016

(65) Prior Publication Data

US 2017/0338602 A1 Nov. 23, 2017

(30) Foreign Application Priority Data

Nov. 13, 2014 (CN) ..... 2014 2 0678699 U

(51) Int. Cl.
*H01R 13/6595* (2011.01)
*H01R 24/60* (2011.01)
*H01R 107/00* (2006.01)

(52) U.S. Cl.
CPC ..... *H01R 13/6595* (2013.01); *H01R 24/60* (2013.01); *H01R 2107/00* (2013.01)

(58) Field of Classification Search
CPC ..... H01R 13/6581; H01R 13/6593; H01R 13/6594; H01R 13/6587; H01R 13/6595
USPC ..... 439/607.27, 607.35, 607.36, 607.37, 439/607.4, 607.55
See application file for complete search history.

(56) References Cited

U.S. PATENT DOCUMENTS 5,718,605 A * 2/1998 Morikawa ..... H01R 12/7047 439/607.27
7,351,105 B2 4/2008 Delaney et al.
7,549,896 B2 * 6/2009 Zhang ..... H01R 12/707 439/607.01

(Continued)

*Primary Examiner* — Tulsidas C Patel
*Assistant Examiner* — Marcus Harcum
(74) *Attorney, Agent, or Firm* — James A. O'Malley

(57) ABSTRACT

An electrical connection device comprises an electrical connector. The electrical connector comprises: an insulative body; a plurality of conductive terminals provided to the insulative body; a metal shell surrounding the insulative body and an outer shielding member. The metal shell comprises a top portion, two openings respectively formed at two sides of the top portion and two first ground pieces positioned opposite to a side where the top portion is present and extending outwardly respectively from the two openings. The outer shielding member comprises a main body transversally provided on the top portion of the metal shell and covering the two openings and two second ground pieces respectively extending outwardly from two ends of the main body, the two second ground pieces each have a penetrating hole penetrating from a top surface to a bottom surface. At least a part of each penetrating hole of the two second ground pieces receives the corresponding first ground piece. By that the outer shielding member covers the two openings of the metal shell, EMI may be prevented from being produced.

16 Claims, 17 Drawing Sheets

(56) References Cited

U.S. PATENT DOCUMENTS

| | | | | |
|---|---|---|---|---|
| 7,883,369 | B1 | 2/2011 | Sun et al. | |
| 8,262,414 | B1 * | 9/2012 | Li | H01R 13/6273 439/607.35 |
| 8,535,097 | B2 * | 9/2013 | Yen | H01R 13/6594 439/607.27 |
| 8,696,383 | B2 * | 4/2014 | Do | H01R 13/6581 439/607.35 |
| 8,740,649 | B2 * | 6/2014 | Lan | H01R 13/506 439/607.4 |
| 8,882,542 | B2 | 11/2014 | Song | |
| 9,088,095 | B2 * | 7/2015 | Yokoyama | H01R 13/60 |
| 2004/0242069 | A1 | 12/2004 | Yang | |
| 2006/0154524 | A1 | 7/2006 | Huang et al. | |
| 2009/0280687 | A1 * | 11/2009 | Liu | H01R 9/032 439/607.55 |
| 2012/0052698 | A1 * | 3/2012 | Shu | H01R 13/6594 439/55 |
| 2013/0203290 | A1 * | 8/2013 | Zhang | H01R 12/724 439/607.36 |
| 2014/0248785 | A1 | 9/2014 | Little et al. | |

* cited by examiner

ELECTRICAL CONNECTION DEVICE

RELATED APPLICATIONS

This application is a national stage of International Application No. PCT/IB2015/002397, filed Nov. 12, 2015, which claims priority to Chinese Application No. 201420678699.2, filed Nov. 13, 2014, both of which are incorporated herein by reference in their entirety.

TECHNICAL FIELD

The present disclosure relates to an electrical connection device, and particularly relates to an electrical connection device for high frequency transmission.

BACKGROUND ART

Taiwanese Utility Model patent TWM271288U (corresponding to United States patent application published as US2006154524A1 and Chinese patent application published as CN2793965Y) discloses a shell for an electrical connector, the shell encloses a terminal seat formed by a housing and terminals so as to form an electrical connector, the electrical connector has a mating port for insertion of a mating connector so as to attain an electrical connection effect. The electrical connector may be fixed to a circuit board as an input/output port for connecting a mating connector.

The shell has at least one first resilient tab and at least one second resilient tab, the first resilient tab is used to interference with a recess of a shell of the mating connector, the second resilient tab is used to clamp the mating connector, both sidewalls of the shell each are provided with a stop member on an appropriate position of an inner side of the sidewall, the stop member is configured as a protruding block formed inwardly on the shell, a distance from the stop member to the mating port corresponds to an insertion depth of the mating connector so as to limit the depth of insertion of the mating connector. Moreover, the shell may be provided with a plurality of soldering legs adapted to fasten the electrical connector on the circuit board by means of surface mounting (SMT).

However, the soldering leg is formed by stamping from a side portion of the shell, thereby forming a penetrating hole (opening) in the shell, the penetrating hole does not bring any problem during low frequency transmission, however, during high frequency transmission, electro-magnetic wave will be emitted through the penetrating hole to produce EMI (Electromagnetic Interference).

SUMMARY

Therefore, an object of the present disclosure is to provide an electrical connection device which has an outer shielding member to prevent EMI from being produced.

Another object of the present disclosure is to provide an electrical connection device having an outer shielding member which shares a fixed position with a metal shell so as to reduce a board area of a circuit board occupied by the outer shielding member.

Still another object of the present disclosure is to provide an electrical connection device which has an outer shielding member to strengthen the structure of the electrical connection device.

Accordingly, in some embodiments, an electrical connection device of the present disclosure comprises an electrical connector. The electrical connector comprises: an insulative body, a plurality of conductive terminals, a metal shell and an outer shielding member. The plurality of conductive terminals are provided to the insulative body. The metal shell is engaged with the insulative body and surrounds the insulative body, and has a top portion, two openings respectively formed at two sides of the top portion and two first ground pieces each positioned at a side of the corresponding opening and extending outwardly from the corresponding opening, the side of the corresponding opening is far away from the top portion. The outer shielding member comprises a main body transversally provided on the top portion of the metal shell and covering the two openings and two second ground pieces respectively extending outwardly from two ends of the main body, the two second ground pieces each have a penetrating hole penetrating from a top surface to a bottom surface, at least a part of each penetrating hole of the two second ground pieces receives the corresponding first ground piece.

In some embodiments, each first ground piece has a pair of side edges spaced apart from each other, and the pair of side edges each are matched with a part of an inner edge of the corresponding second ground piece defining the penetrating hole in a manner of convex-concave.

In some embodiments, each second ground piece has two stop portions positioned close to the main body respectively at two sides of the penetrating hole and protruding toward each other, the two side edges of each first ground piece are recessed inwardly respectively in the positions corresponding to the two stop portions.

In some embodiments, the main body of the outer shielding member has two position limiting portions respectively adjacent to the two penetrating holes and respectively positioned above the two corresponding first ground pieces.

In some embodiments, each first ground piece has a pair of side edges spaced apart from each other and an end edge connecting the pair of side edges, the end edge of the first ground piece and a part of the inner edge of the corresponding second ground piece defining the penetrating hole cooperatively define a through hole.

In some embodiments, the insulative body comprises a housing, a tongue extending forwardly from the housing, and two side walls respectively extending rearwardly from two sides of the housing, the plurality of conductive terminals are provided to the insulative body in arrangement of an upper row and a lower row, and each conductive terminal has a fixed portion fixed to the housing, a contact portion extending forwardly from the fixed portion to the tongue, and a resilient tail portion extending rearwardly from the fixed portion and extending out of the housing, the resilient tail portions of the conductive terminals in the two rows are positioned between the side walls.

In some embodiments, the plurality of conductive terminals are provided to the insulative body in arrangement of an upper row and a lower row; and the electrical connector further comprises a ground metal piece provided to the insulative body and positioned between the conductive terminals in the upper row and the conductive terminals in the lower row, the ground metal piece comprises a body portion and at least a connecting portion, the connecting portion protrudes outwardly from the body portion, extends out of the insulative body and contacts the metal shell.

In some embodiments, the electrical connection device further comprises a circuit board, the circuit board is provided with two ground pads; the first ground piece and the second ground piece which are positioned at the same side are together fixed to and electrically connected to the corresponding ground pad.

In some embodiments, the circuit board is further provided with two mounting holes respectively positioned within two regions where the two ground pads are respectively provided; each first ground piece has a pair of side edges spaced apart from each other and an end edge connecting the pair of side edges, the end edge of the first ground piece and a part of the inner edge of the corresponding second ground piece defining the penetrating hole cooperatively define a through hole, the two through holes respectively correspond to the two mounting holes of the circuit board; and the electrical connection device further comprises two fixing members, each fixing member passes through the corresponding through hole and the corresponding mounting hole, fixes the corresponding first ground piece and the corresponding second ground piece to the circuit board, and allows the first ground piece and the second ground piece to contact the corresponding ground pad.

In some embodiments, the first ground piece and the second ground piece which are positioned at the same side are together fixed to the corresponding ground pad by soldering.

In some embodiments, each first ground piece has a pair of side edges spaced apart from each other and an end edge connecting the pair of side edges, the end edge of the first ground piece and a part of the inner edge of the corresponding second ground piece defining the penetrating hole cooperatively define a through hole.

In some embodiments, the circuit board is further provided with a mounting groove formed between the two ground pads, and is further provided with a protruding portion protruding into the mounting groove, a plurality of conductive contact pieces correspondingly provided to an upper surface and a lower surface of the protruding portion, the electrical connector is provided in the mounting groove; the insulative body comprises a housing, a tongue extending forwardly from the housing, and two side walls respectively extending rearwardly from two sides of the housing, the two side walls are positioned at two sides of the protruding portion; the plurality of conductive terminals are provided to the insulative body in arrangement of an upper row and a lower row, and each conductive terminal has a fixed portion fixed to the housing, a contact portion extending forwardly from the fixed portion to the tongue, and a resilient tail portion extending rearwardly from the fixed portion and extending out of the housing, the resilient tail portions of the conductive terminals in the two rows are positioned between the side walls, the resilient tail portions of the conductive terminals in the upper row and the conductive terminals the lower row respectively contact the conductive contact pieces on the upper surface of the protruding portion and the conductive contact pieces on the lower surface of the protruding portion so as to interpose the protruding portion therebetween.

In some embodiments, the electrical connector further comprises a ground metal piece provided to the insulative body and positioned between the conductive terminals in the upper row and the conductive terminals in the lower row, the ground metal piece comprises a body portion and at least a connecting portion, the connecting portion protrudes outwardly from the body portion, extends out of the insulative body and contacts the metal shell.

In some embodiments, the metal shell further comprises a bottom portion spaced apart from the top portion and two side portions each connecting the top portion and the bottom portion, the metal shell is formed by a metal plate and an engagement portion is formed in the top portion, and the two first ground pieces are respectively formed from the two side portions by stamping the two side portions.

In some embodiments, the main body of the outer shielding member and the top portion of the metal shell are tightly connected by at least a laser joint.

In some embodiments, the two first ground pieces are coplanar respectively with the two second ground pieces.

The effects of the present disclosure are as follows: by that the outer shielding member covers the two openings of the metal shell, EMI may be prevented from being produced during high frequency transmission of the electrical connector. In addition, because the two first ground pieces each are received in the penetrating hole of the corresponding second ground piece, it is convenient to fix the first ground piece and the second ground piece together to the corresponding ground pad of the circuit board by means of soldering connection or threaded connection, so that the first ground piece and the second ground piece establish an electrical connection with the corresponding ground pad, the first ground piece and the second ground piece may share the fixed position so as to reduce an occupied area on the circuit board, and provide a plurality of ground paths to attain better ground effect. Furthermore, the outer shielding member may strengthen the whole structural strength of the electrical connection device.

BRIEF DESCRIPTION OF THE DRAWINGS

The other features and effects of the present disclosure will be apparent through the detailed description of embodiments with reference to the Figures, and in Figures.

DETAILED DESCRIPTION OF THE PREFERRED EMBODIMENTS

Figure 1:
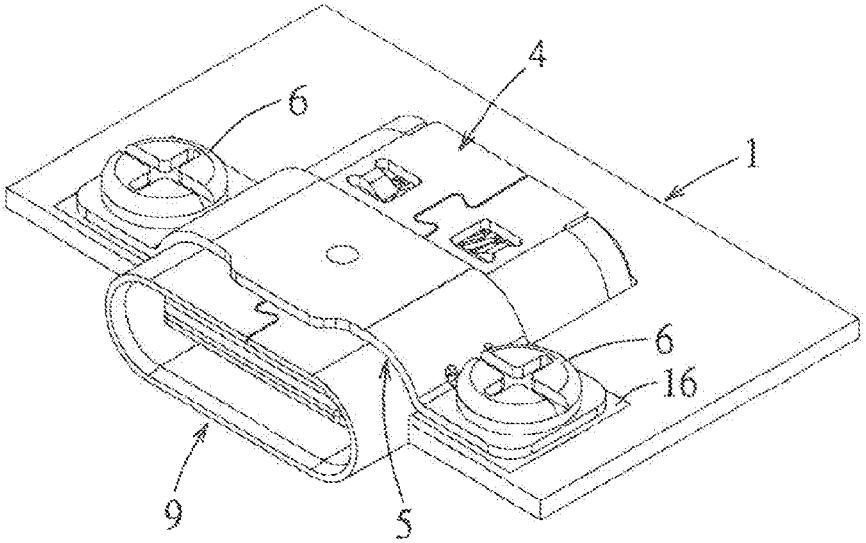
FIG. 1 is a perspective view illustrating an electrical connection device in a first embodiment of the present disclosure.

Before the present disclosure is described in detail, it should be noted that the similar element is identified by the same reference numeral.

Referring to FIG. 1 to FIG. 6, an electrical connection device in a first embodiment of the present disclosure comprises a circuit board 1, an electrical connector 9 and two fixing members 6. The circuit board 1 is provided with a mounting groove 18, a protruding portion 12 protruding into the mounting groove 18, a plurality of conductive contact pieces 13 correspondingly provided to an upper surface and a lower surface of the protruding portion 12, two ground pads 16 respectively provided at two sides of the mounting groove 18, and two mounting holes 17 respectively positioned within two regions where the two ground pads 16 are respectively provided. The electrical connector 9 is provided to the circuit board 1 in form of sinking and positioned in the mounting groove 18.

Referring to FIG. 5 to FIG. 9, the electrical connector 9 comprises: an insulative body 2, a plurality of conductive terminals 3, a metal shell 4, a ground metal piece 8, an inner shielding shell 91 and an outer shielding member 5.

The insulative body 2 is composed of a first insulative member 26 and a second insulative member 27, and comprises a housing 21, a tongue 22 extending forwardly from the housing 21, and two side walls 23 respectively extending rearwardly from two sides of the housing 21. Each side wall 23 has a positioning groove 25 formed in an inner wall surface thereof, when the electrical connector 9 is mated with the circuit board 1, the two positioning grooves 25 may be used for insertion of the protruding portion 12 of the circuit board 1 (see FIG. 6).

Figure 10:
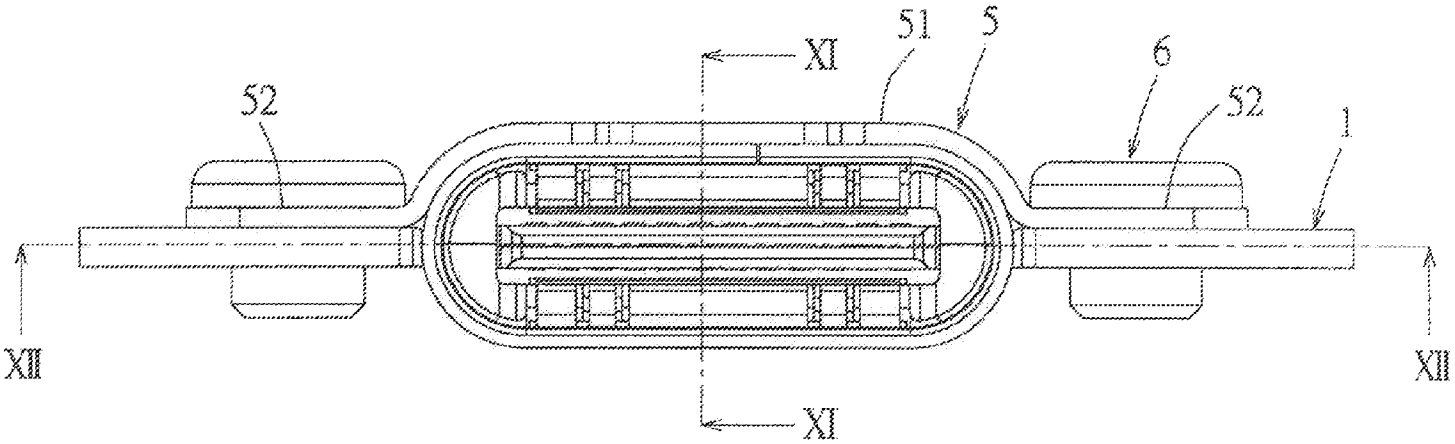
FIG. 10 is a front view illustrating the first embodiment.
Figure 11:
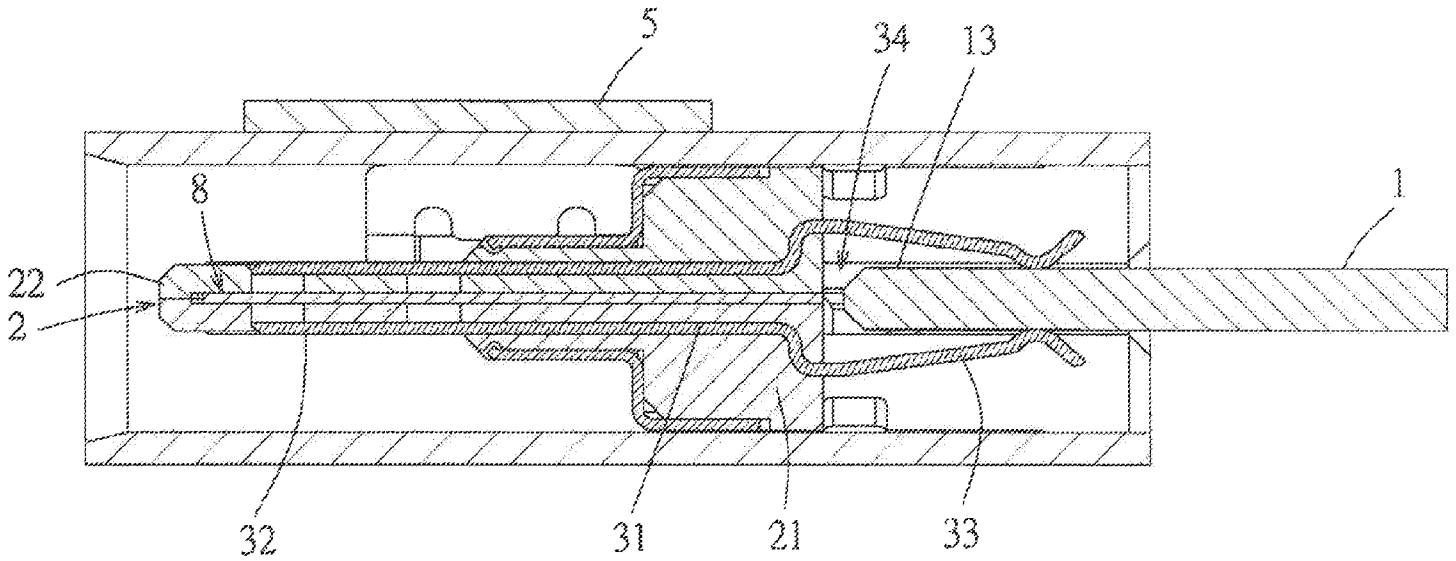
FIG. 11 is a cross sectional view taken along a line XI-XI of FIG. 10 and illustrating an engagement relationship among the conductive terminals and the insulative body of the electrical connector and the circuit board in the first embodiment.

Further referring to FIG. 10 and FIG. 11, the plurality of conductive terminals 3 are provided to the insulative body 2 in arrangement of an upper row and a lower row. In the present embodiment, the conductive terminals 3 in the upper row are provided to the first insulative member 26, and the conductive terminals 3 in the lower row are provided to the second insulative member 27. Each conductive terminal 3 has a fixed portion 31 fixed to the housing 21, a contact portion 32 extending forwardly from the fixed portion 31 to the tongue 22, and a resilient tail portion 33 extending rearwardly from the fixed portion 31 and extending out of the housing 21, the resilient tail portions 33 of the conductive terminals 3 in the two rows are positioned between the two side walls 23 and the resilient tail portions 33 in the upper row and the resilient tail portions 33 in the lower row cooperatively define an insertion space 34. When the electrical connector 9 is mounted to the circuit board 1, the protruding portion 12 is inserted into the insertion space 34, the resilient tail portions 33 of conductive terminals 3 in the upper row and the resilient tail portions 33 in the lower row respectively contact the conductive contact pieces 13 on the upper surface of the protruding portion 12 and the conductive contact pieces 13 on the lower surface of the protruding portion 12 so as to interpose the protruding portion 12 therebetween, and two sides of the protruding portion 12 will be respectively inserted into the two positioning grooves 25, thereby attaining positioning and sliding-prevent effect.

Referring to FIG. 4 to FIG. 7, the metal shell 4 is engaged with the insulative body 2 and surrounds the insulative body 2, and comprises a top portion 41, a bottom portion 42 spaced apart from the top portion 41, two side portions 43 each connecting the top portion 41 and the bottom portion 42, two openings 45 respectively formed at two sides of the top portion 41, and two first ground pieces 46 each positioned at a side of the corresponding opening 45 and extending outwardly from the corresponding opening 45, the side of the corresponding opening 45 is far away from the top portion 41, the metal shell 4 is formed by a metal plate and an engagement portion 44 is formed in the top portion 41, and the two first ground pieces 46 are respectively formed from the two side portions 43 by stamping the two side portions 43. The two first ground pieces 46 respectively correspond to the two ground pads 16 of the circuit board 1 and are mounted to the circuit board 1, each first ground piece 46 has a pair of side edges 461 spaced apart from each other and an end edge 462 connecting the pair of side edges 461.

Figure 7:
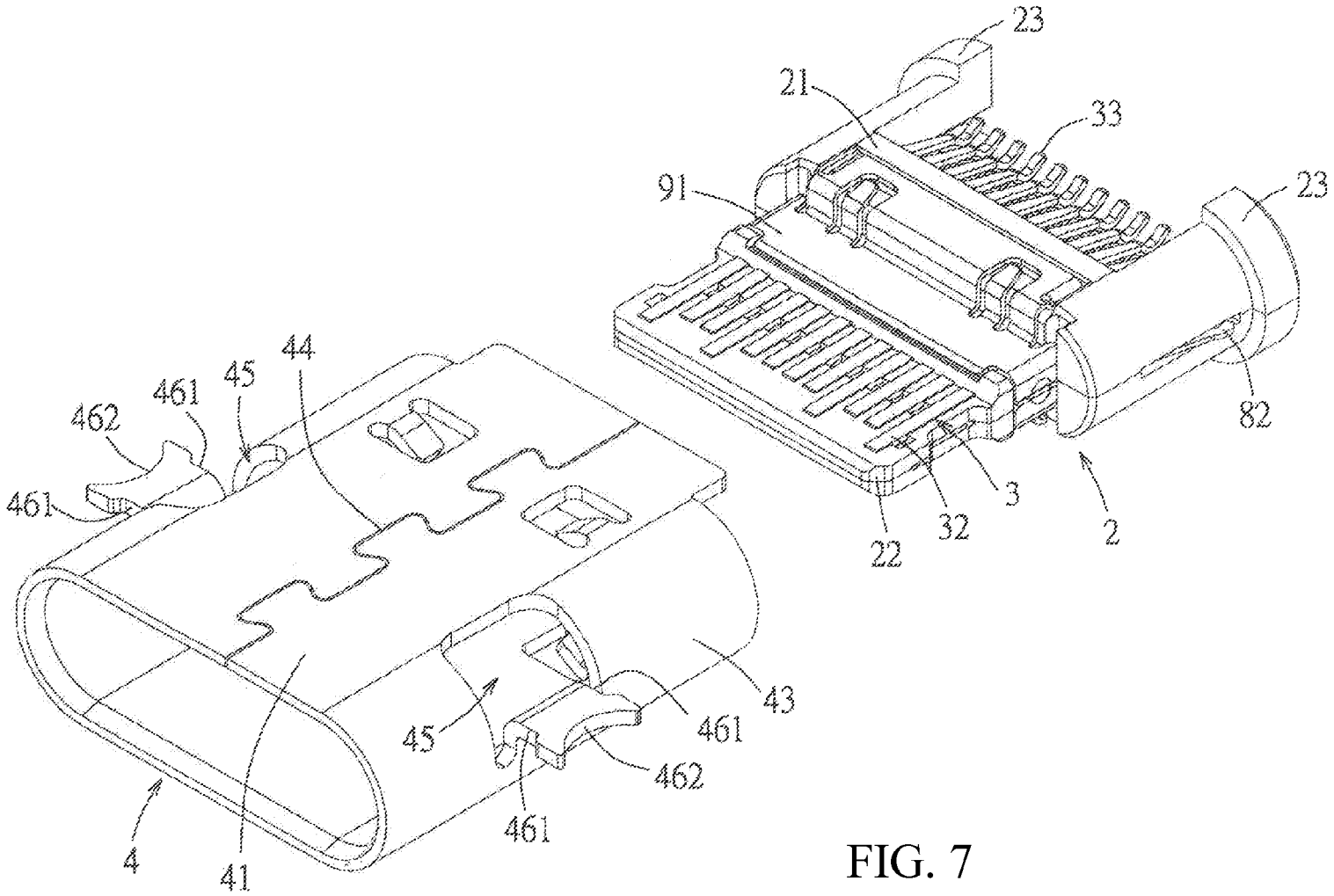
FIG. 7 is an exploded perspective view illustrating an assembling relationship between the metal shell and an insulative body in the first embodiment.
Figure 8:
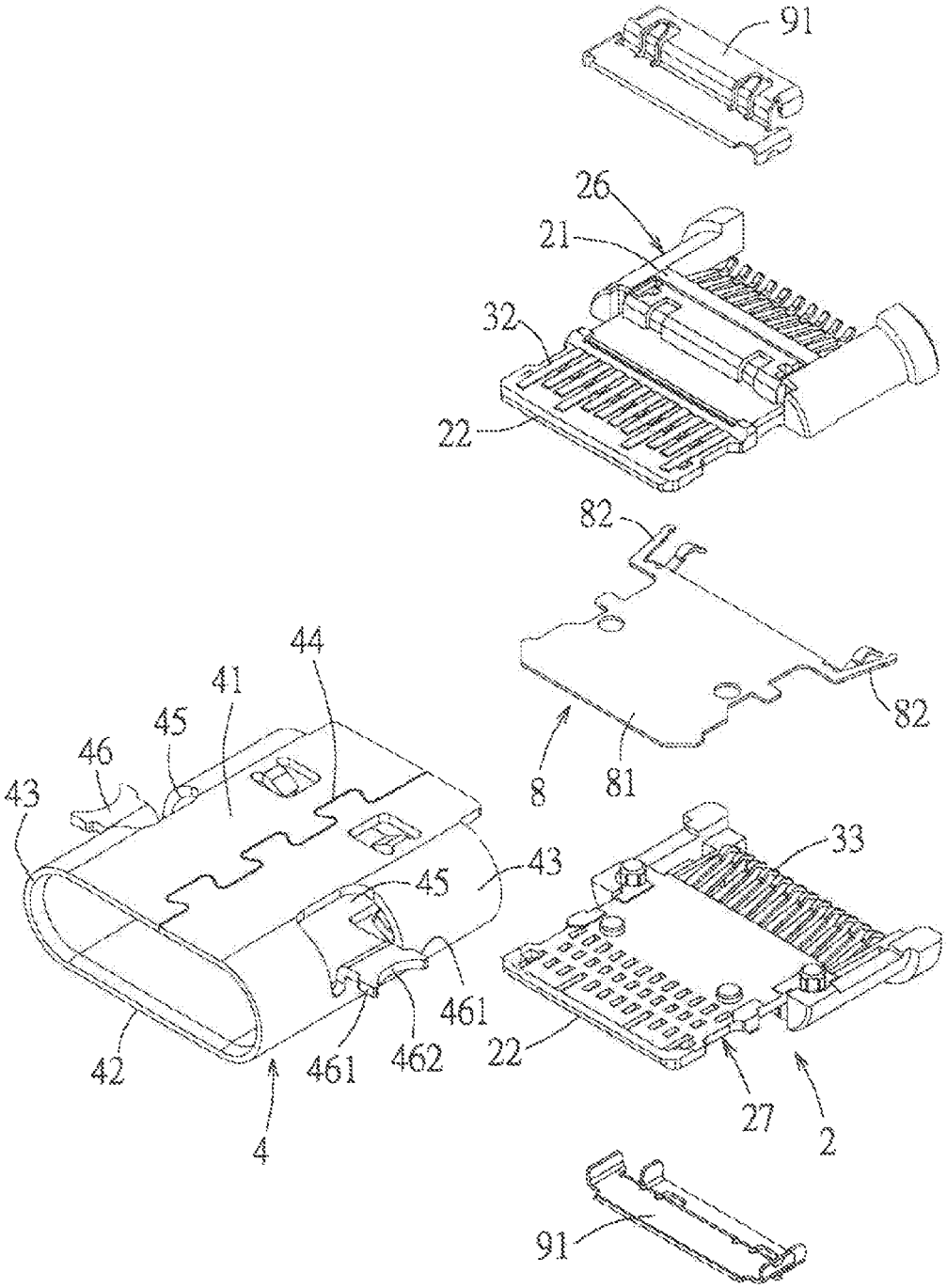
FIG. 8 is an exploded perspective view illustrating an assembling relationship among components of the electrical connector in the first embodiment.
Figure 9:
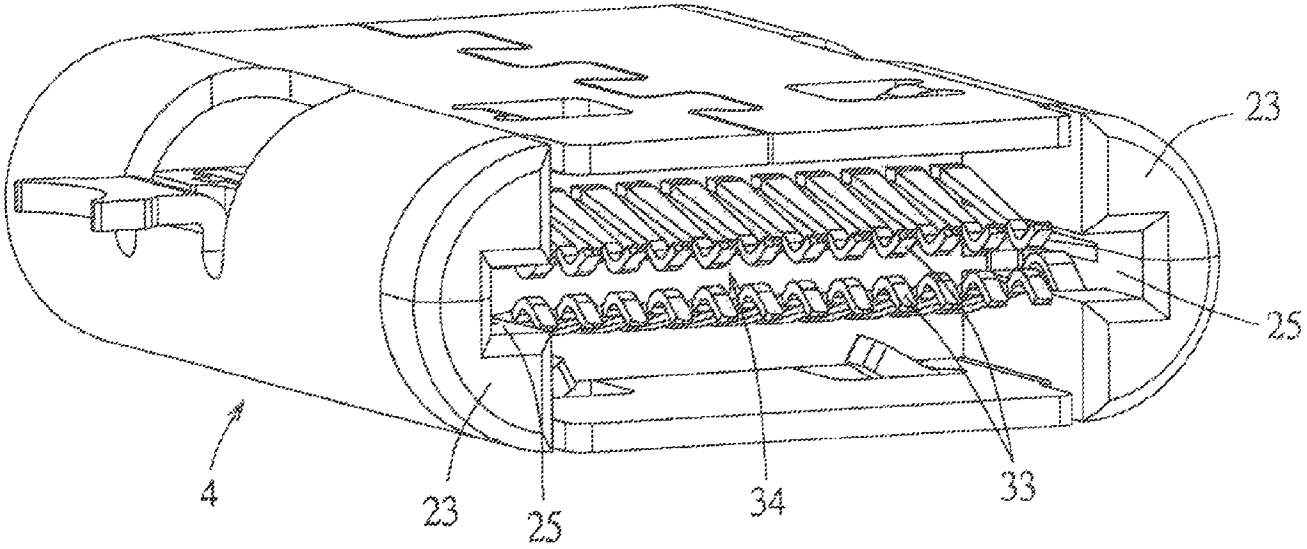
FIG. 9 is a perspective view illustrating an arrangement relationship among tail portions of conductive terminals of the electrical connector in two rows in the first embodiment.
Figure 12:
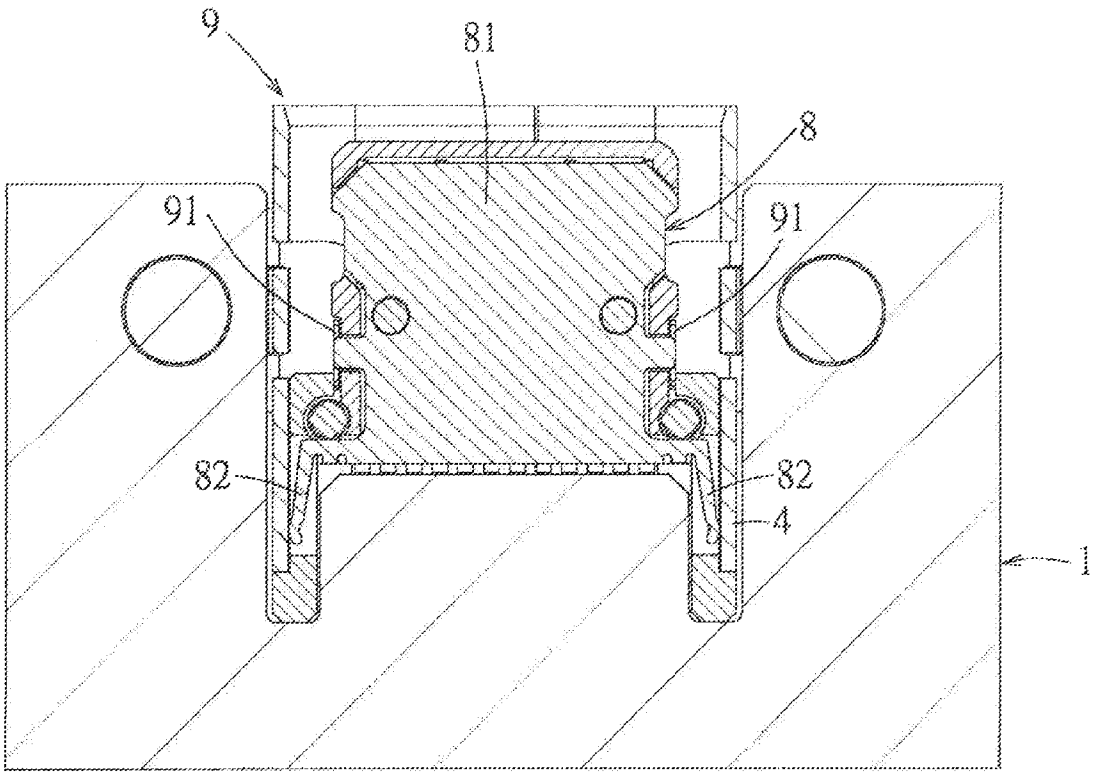
FIG. 12 is a cross sectional view taken along a line XII-XII of FIG. 10 and illustrating an assembling relationship between the electrical connector and the circuit board in the first embodiment.
Figure 13:
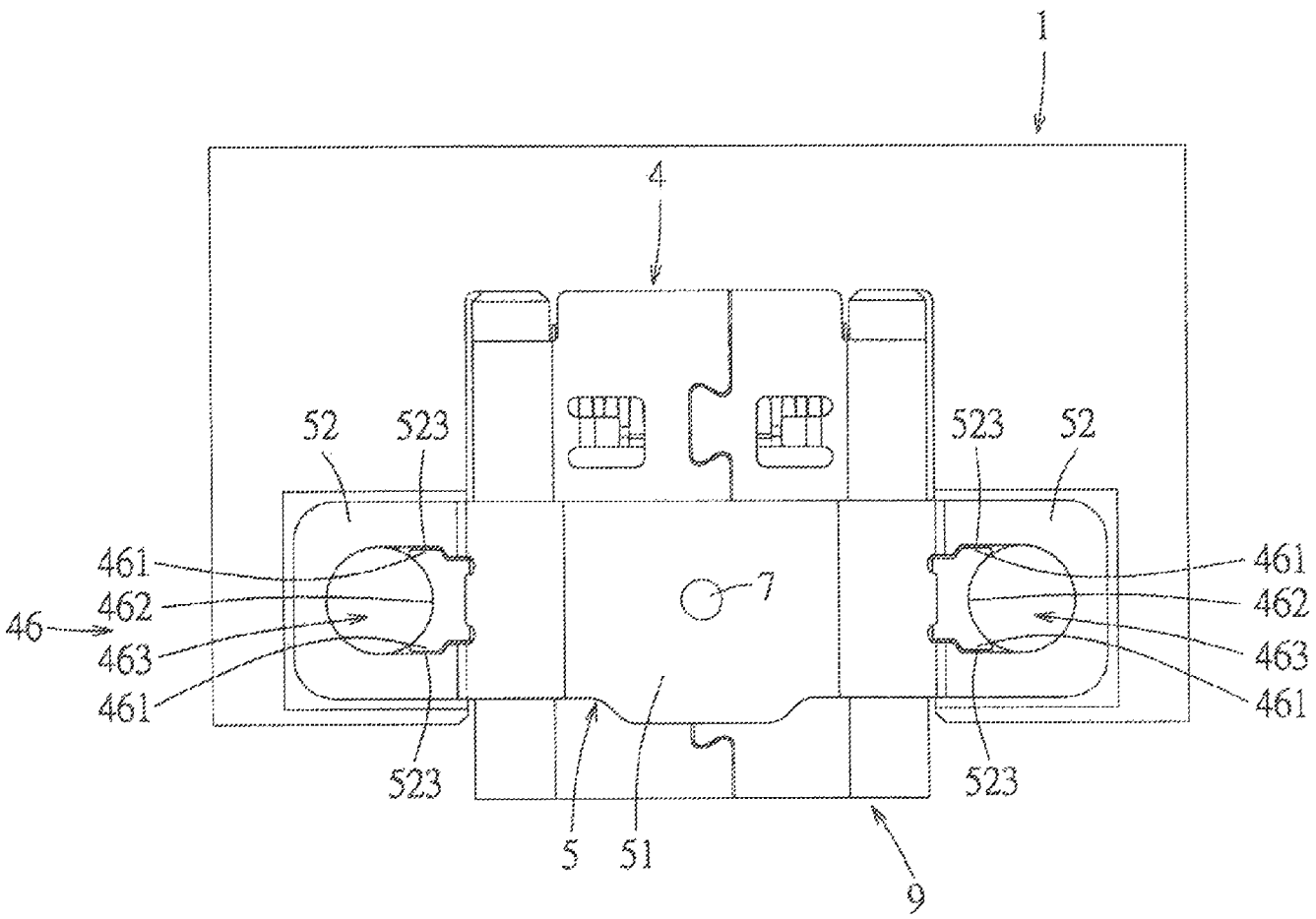
FIG. 13 is a top view illustrating an assembling relationship between two second ground pieces of the outer shielding member and two first ground pieces of the metal shell in the first embodiment.
Figure 14:
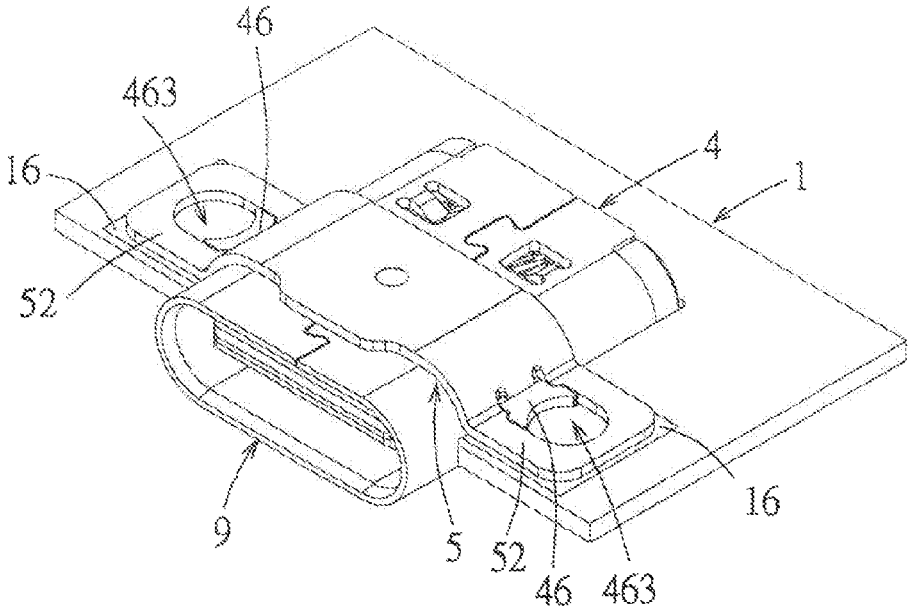
FIG. 14 is a perspective view illustrating an electrical connection device in a second embodiment of the present disclosure.
Figure 15:
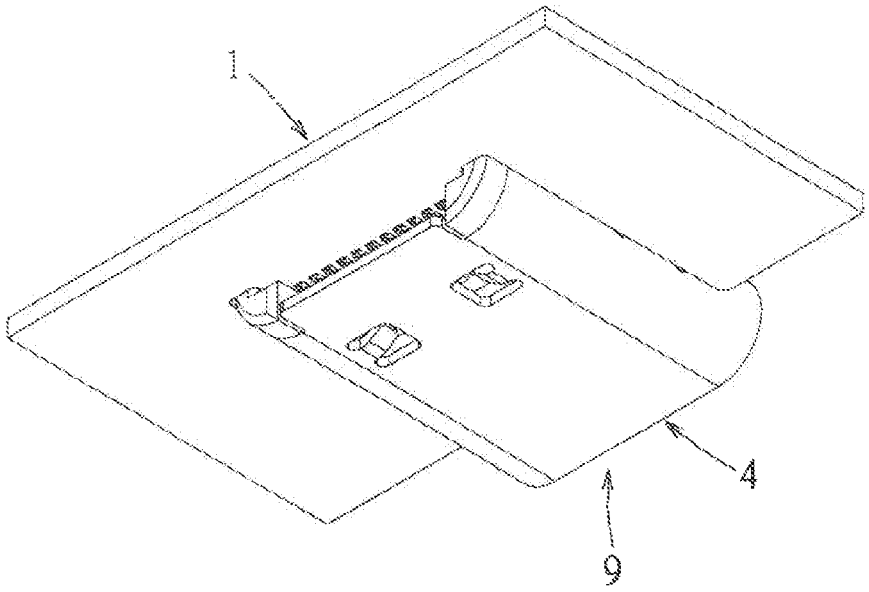
FIG. 15 is a view of FIG. 14 viewed from another angle illustrating the second embodiment.
Figure 16:
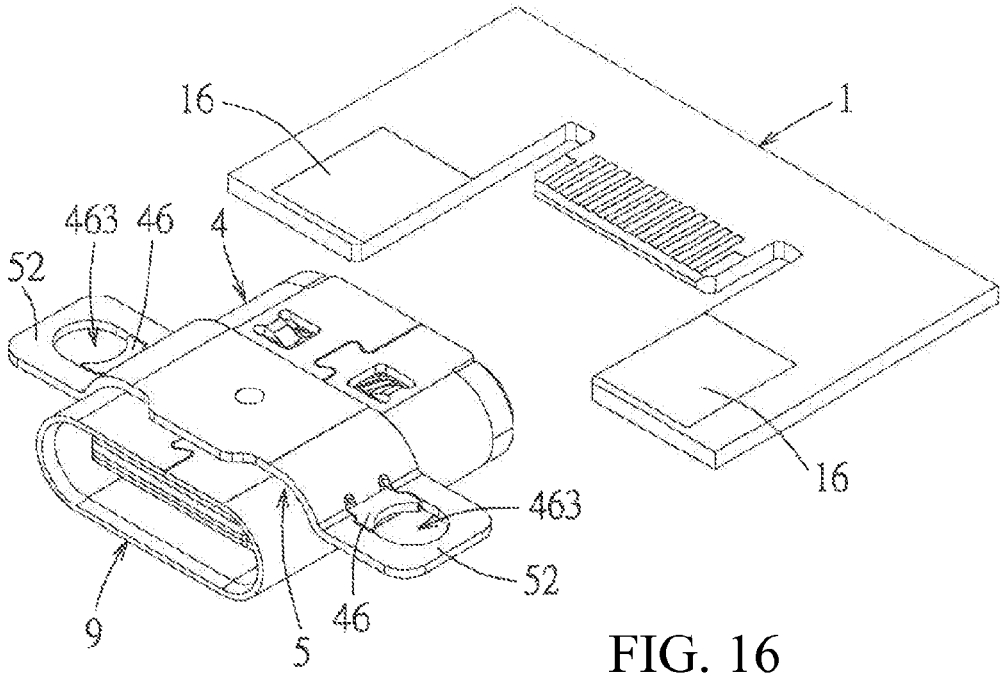
FIG. 16 is an exploded perspective view illustrating an assembling relationship between a circuit board and an electrical connector in the second embodiment.
Figure 17:
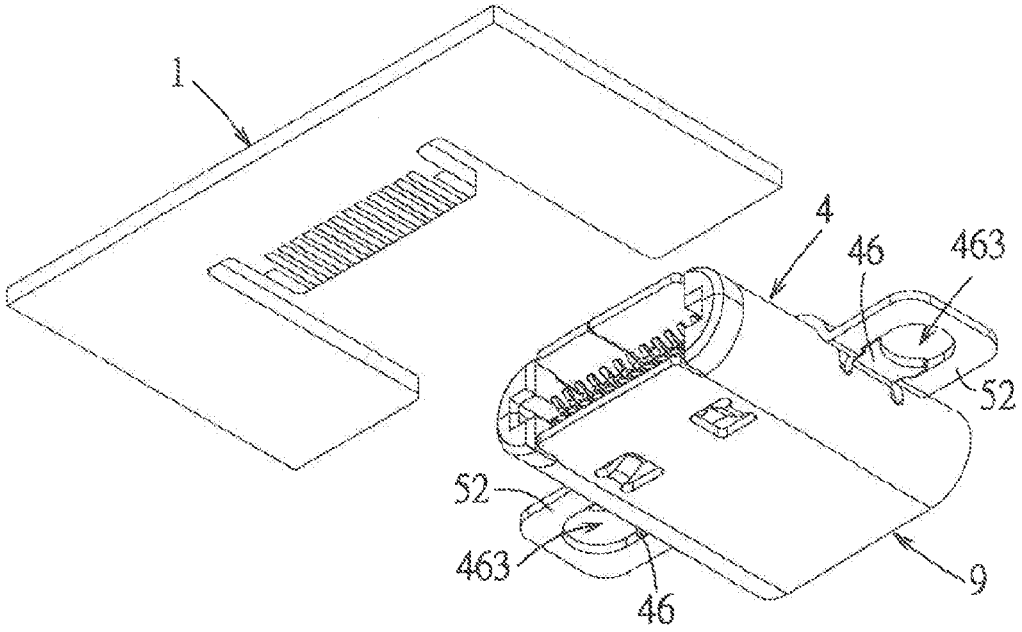
FIG. 17 is a view of FIG. 16 viewed from another angle.
Figure 18:
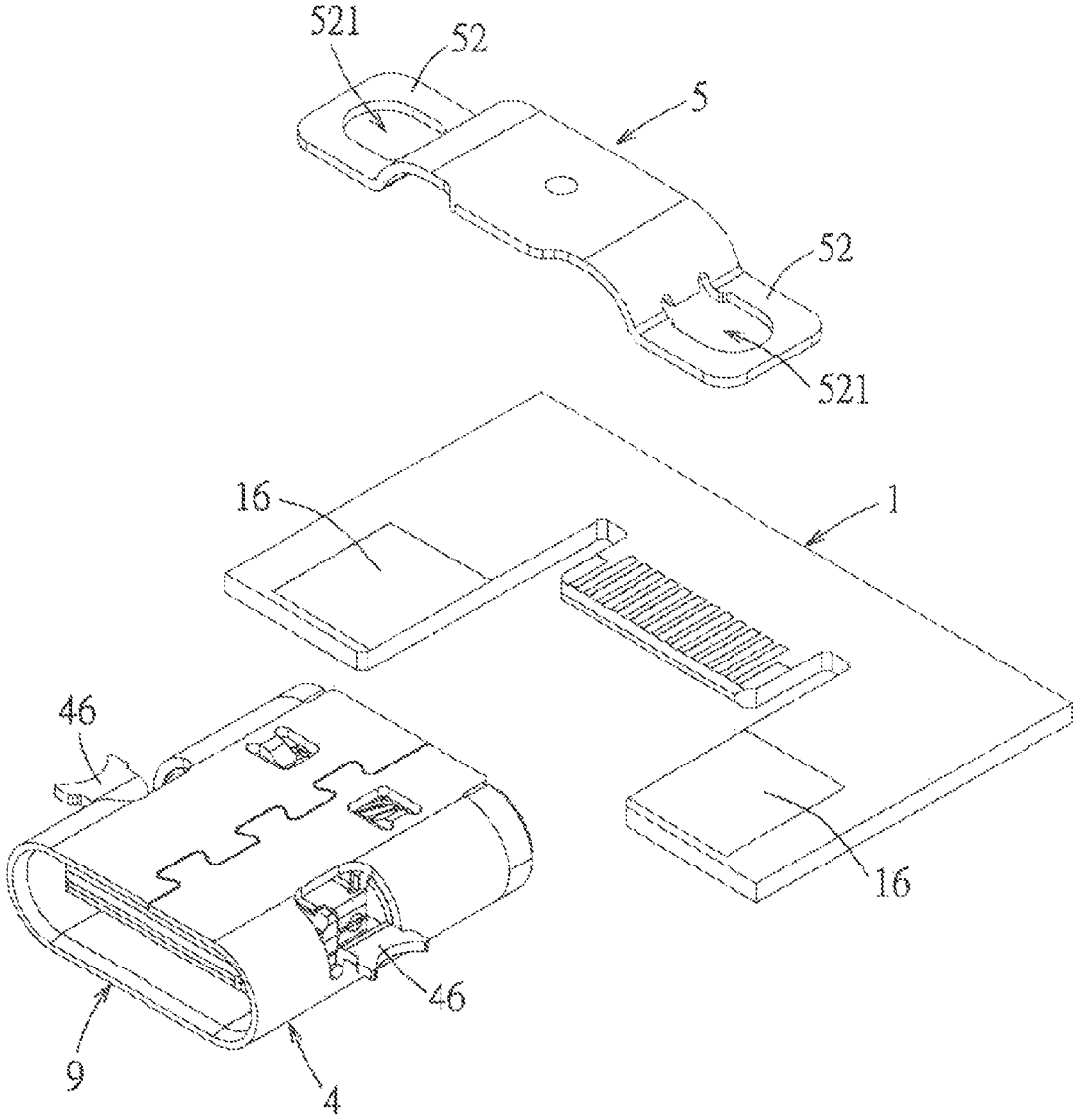
FIG. 18 is an exploded perspective view illustrating an assembling relationship between an outer shielding member and a metal shell of the electrical connector in the second embodiment.
Figure 19:
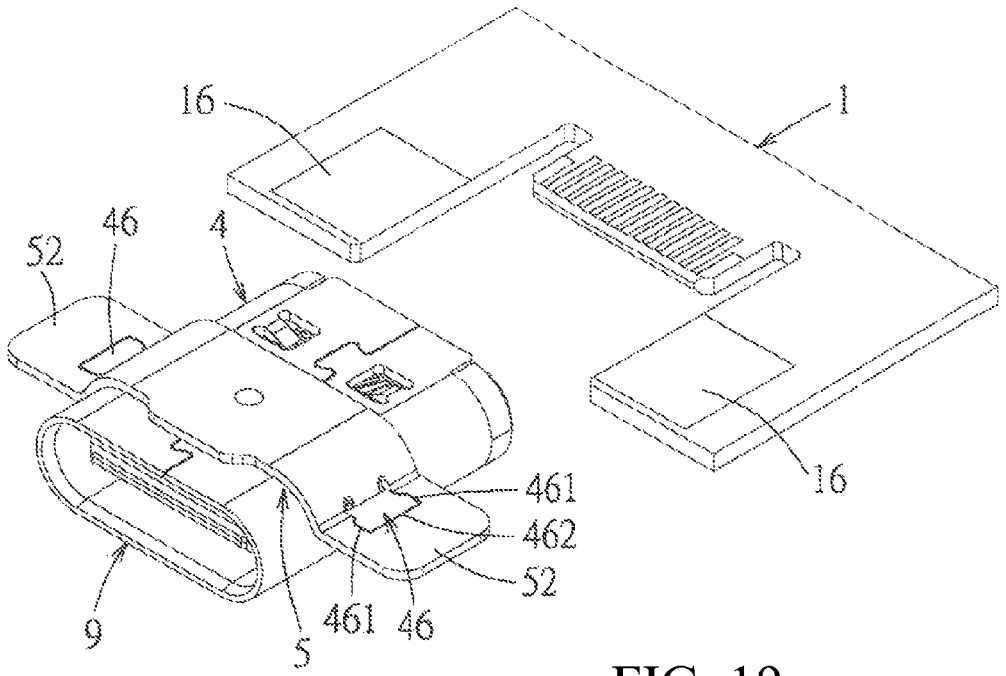
FIG. 19 is an exploded perspective view illustrating an assembling relationship between an electrical connector and a circuit board of an electrical connection device in a third embodiment of the present disclosure.
Figure 20:
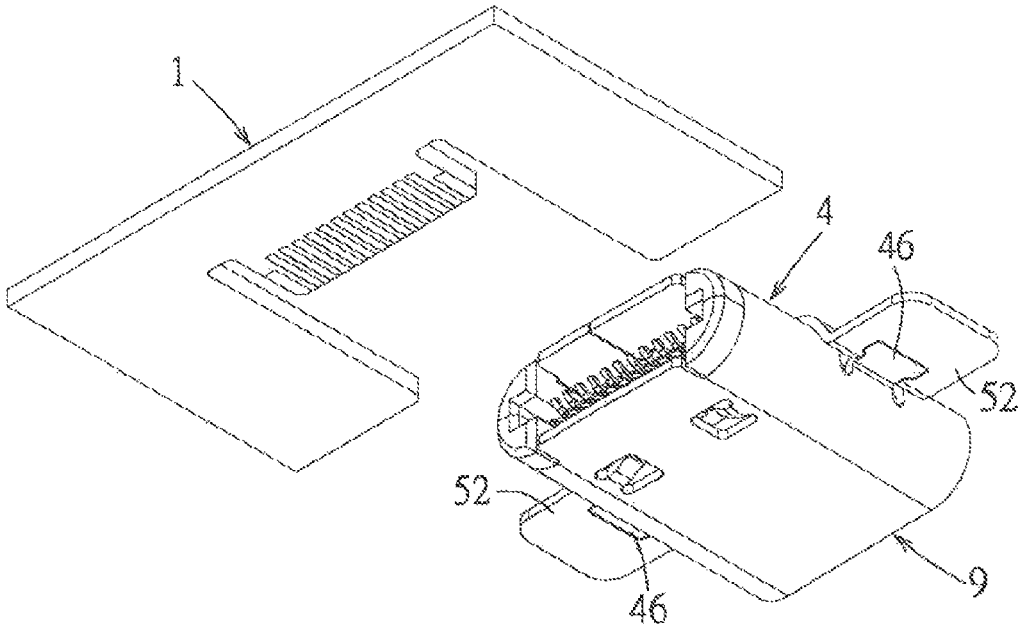
FIG. 20 is a view of FIG. 19 viewed from another angle.
Figure 21:
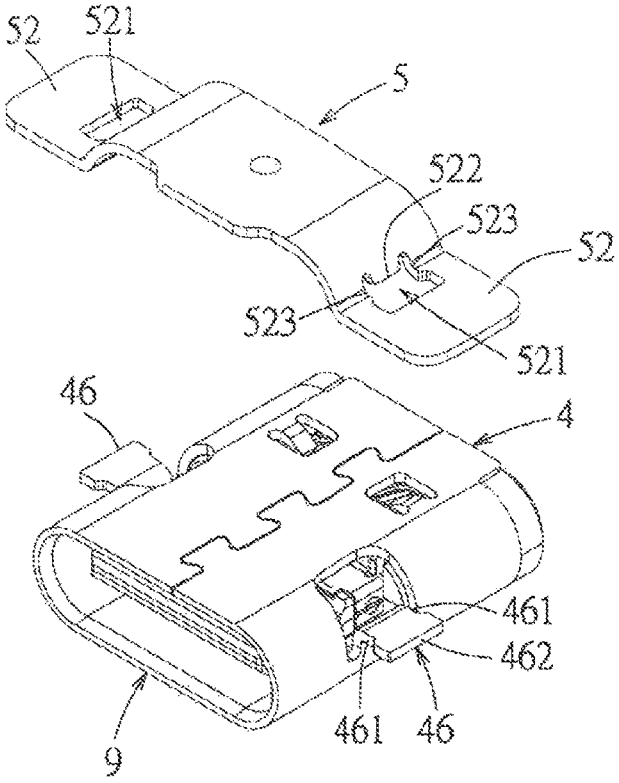
FIG. 21 is an exploded perspective view illustrating an assembling relationship between an outer shielding member and a metal shell of the electrical connector in the third embodiment.
Figure 22:
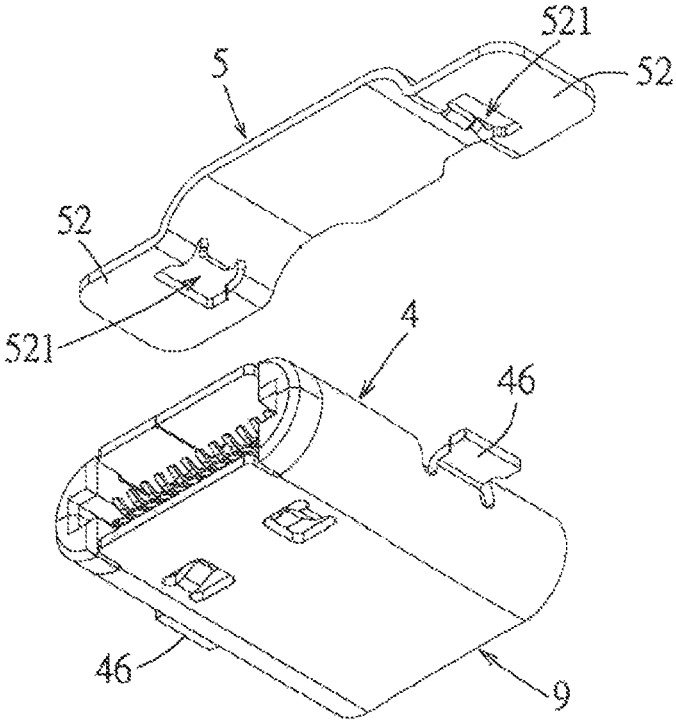
FIG. 22 is a view of FIG. 21 viewed from another angle.

Referring to FIG. 7, FIG. 8 and FIG. 12, the ground metal piece 8 comprises a body portion 81 and two connecting portions 82. The body portion 81 is interposed between the first insulative member 26 and the second insulative member 27, that is, the body portion 81 is provided to the insulative body 2 and positioned between the conductive terminals 3 in the upper row and the conductive terminals 3 in the lower row, the two connecting portions 82 protrude from the body portion 81, extend out of the insulative body 2 and contact the metal shell 4 so as to establish a ground path. The ground metal piece 8 is mainly positioned in a region where the tongue 22 is present so as to prevent the conductive terminals 3 in the upper row and the lower row from crosstalk.

The inner shielding shell 91 is formed by a metal and covers surfaces of the housing 21 of the insulative body 2 so as to increase shielding effect.

Referring to FIG. 3 to FIG. 6 and FIG. 13, the outer shielding member 5 is formed by a metal, and comprises a main body 51 transversally provided on the top portion 41 of the metal shell 4 and covering the two openings 45 and two second ground pieces 52 respectively extending outwardly from two ends of the main body 51. The second ground pieces 52 respectively correspond to the two ground pads 16 of the circuit board 1 and are mounted to the circuit board 1, and the second ground pieces 52 each have a penetrating hole 521 penetrating from a top surface to a bottom surface. In the present embodiment, a part of each penetrating hole 521 of the second ground pieces 52 receives the corresponding first ground piece 46, and the side edge 461 of each first ground piece 46 is matched with one part of an inner edge of the corresponding second ground piece 52 defining the penetrating hole 521 in a manner of concave-convex, the end edge 462 of the first ground piece 46 and the other part of the inner edge of the corresponding second ground piece 52 defining the penetrating hole 521 cooperatively define a through hole 463. The two through holes 463 respectively correspond to the two mounting holes 17 of the circuit board 1 for insertion of the fixing members 6. Specifically, each second ground piece 52 has two stop portions 523 positioned close to the main body 51 respectively at two sides of the penetrating hole 521 and protruding toward each other, and the two side edges 461 of each first ground piece 46 are recessed inwardly respectively in the positions corresponding to the two stop portions 523 so as to be matched with the corresponding second ground piece 52 in a manner of concave-convex. In addition, the two first ground pieces 46 are substantively coplanar respectively with the two second ground pieces 52, so as to allow the two first ground pieces 46 and the two second ground pieces 52 to be positioned along a direction parallel to the surface of the circuit board 1. As such, the first ground piece 46 may be prevented from moving inwardly toward the mounting groove 18 by the second ground piece 52. Moreover, the main body 51 of the outer shielding member 5 has two position limiting portions 522 respectively adjacent to the two penetrating holes 521 and respectively positioned above the two corresponding first ground pieces 46, so as to prevent the two first ground pieces 46 from moving upwardly. Furthermore, in the present embodiment, the main body 51 of the outer shielding member 5 and the top portion 41 of the metal shell 4 are tightly connected by a laser joint 7, which may not only allow the outer shielding member 5 and the metal shell 4 to stably contact with each other, but also strengthen the engagement strength of the metal shell 4 because the outer shielding member 5 transversally covers across the engagement portion 44 of the metal shell 4. Also, the outer shielding member 5 acts on the two first ground pieces 46 of the metal shell 4 in position limiting, the whole structural strength of the electrical connection device can be also strengthened. Certainly, the laser joint 7 may be provided as multiple in number, and the number is not limited to that of the present embodiment.

Figure 2:
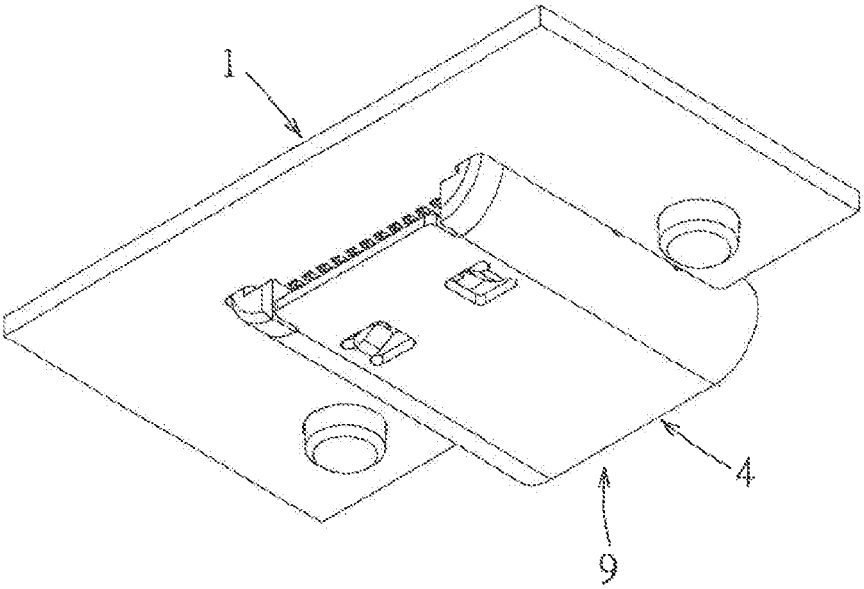
FIG. 2 is a view of FIG. 1 viewed from another angle illustrating the first embodiment.
Figure 3:
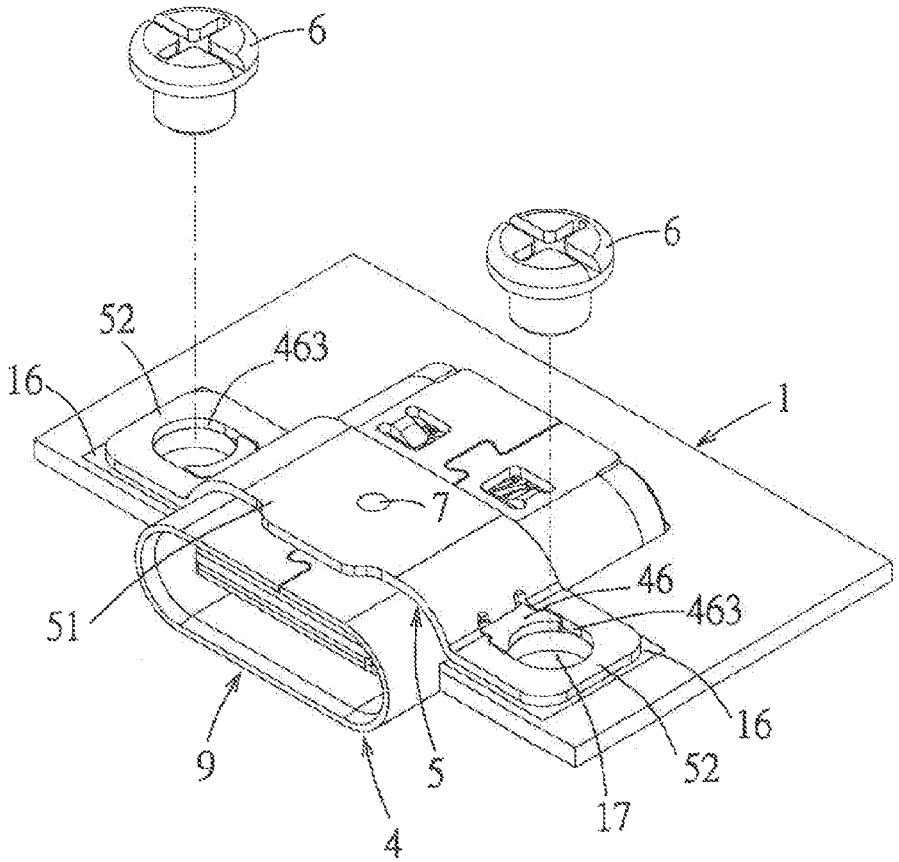
FIG. 3 is an exploded perspective view illustrating an assembling relationship among a fixing member, an electrical connector and a circuit board in the first embodiment.
Figure 4:
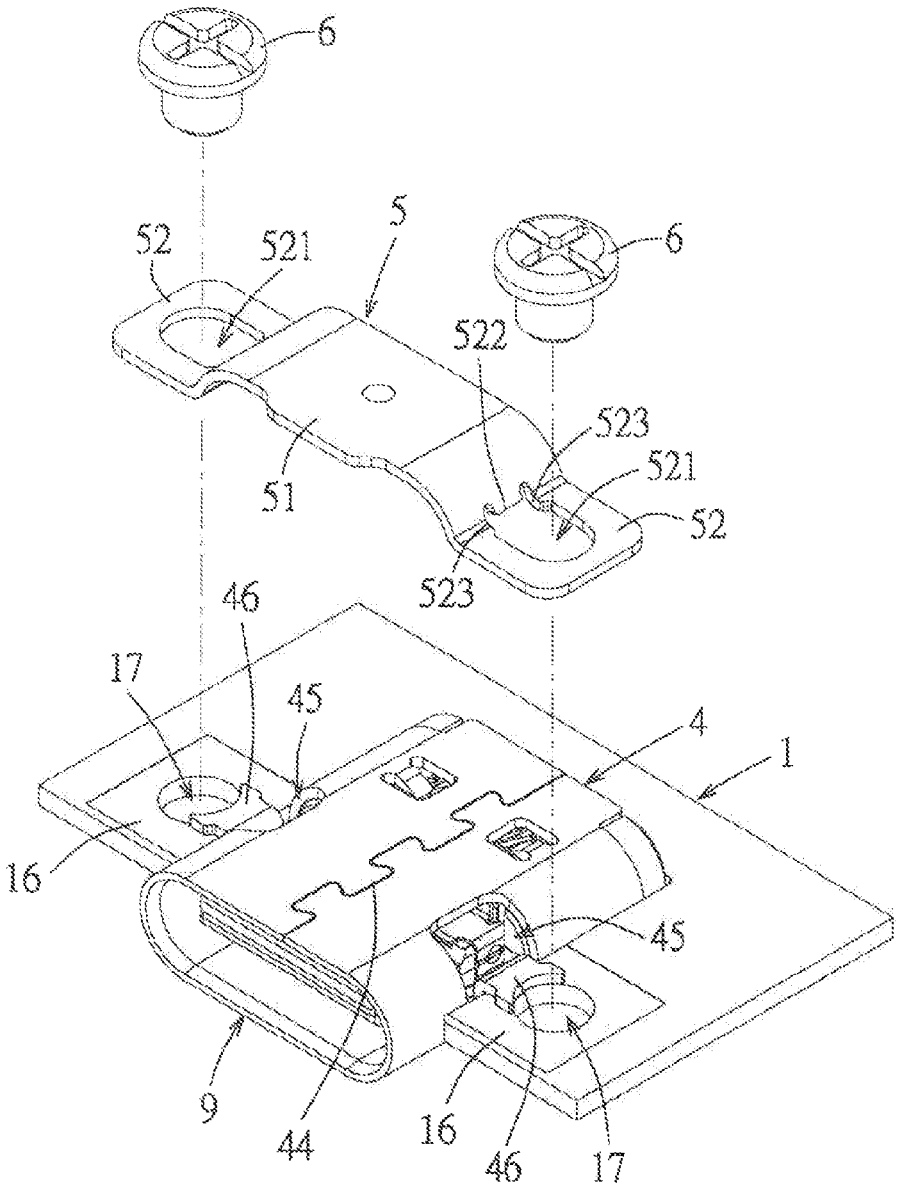
FIG. 4 is an exploded perspective view illustrating an assembling relationship among an outer shielding member, a metal shell and the circuit board in the first embodiment.
Figure 5:
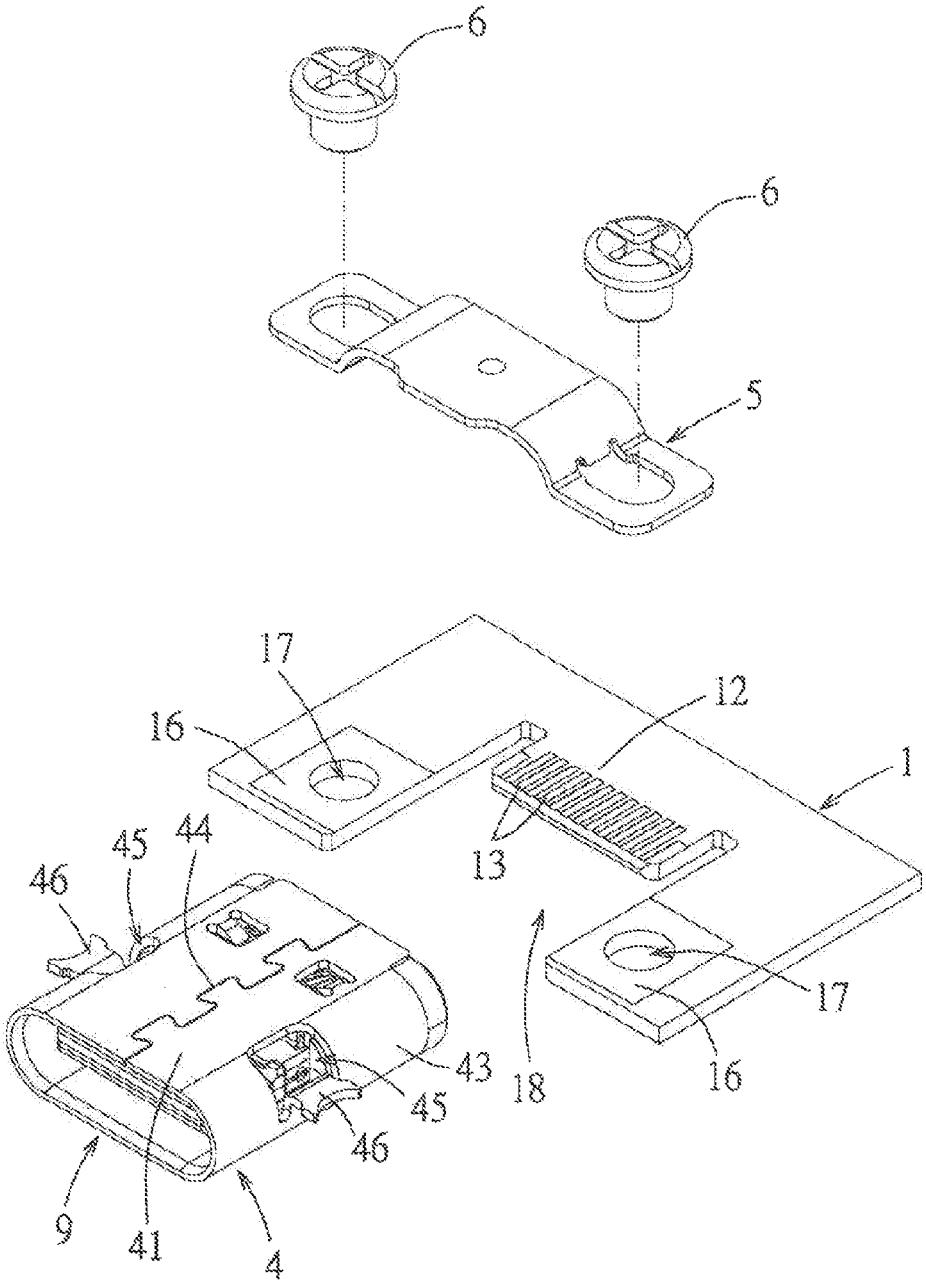
FIG. 5 is an exploded perspective view illustrating an assembling relationship between the electrical connector and the circuit board in the first embodiment.
Figure 6:
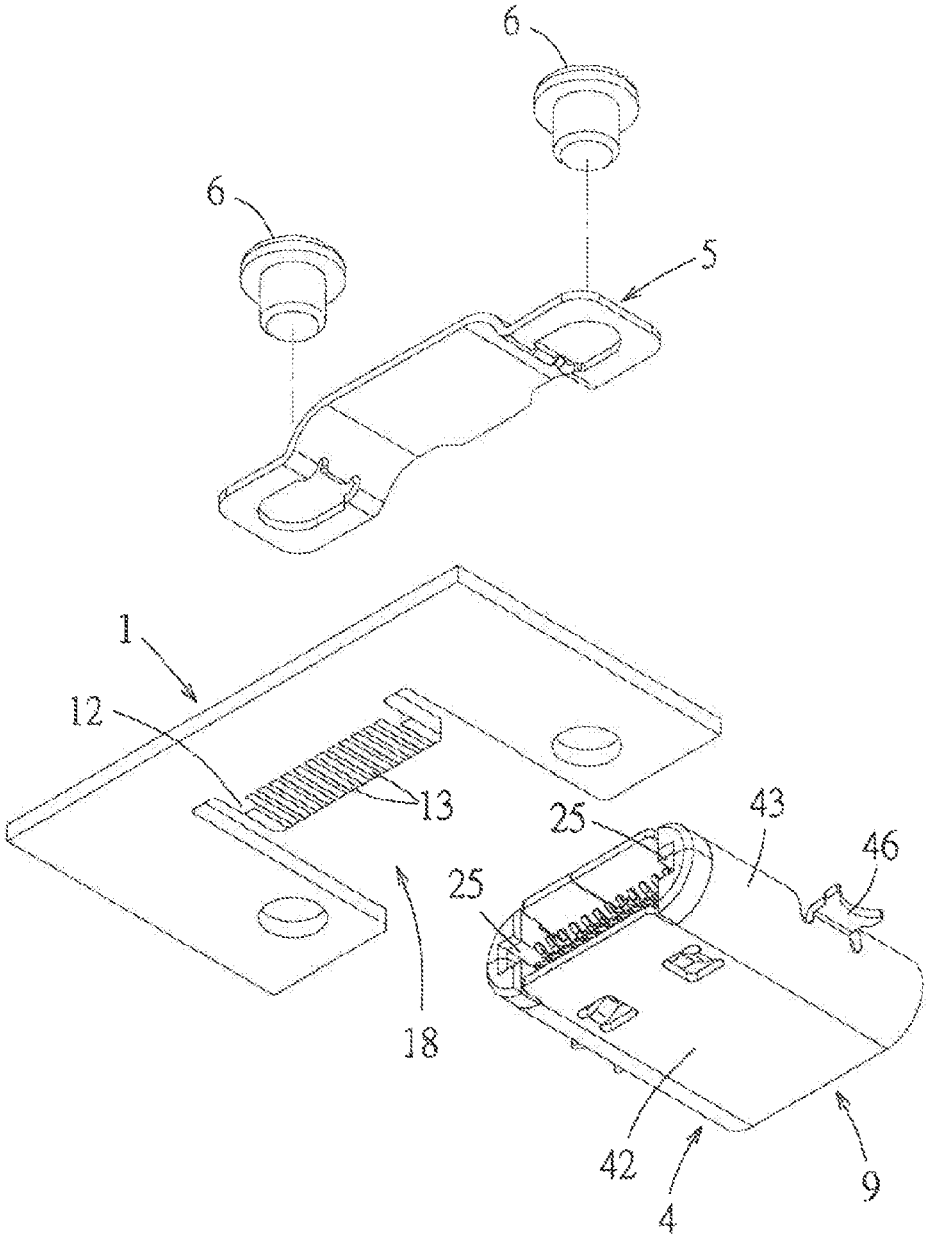
FIG. 6 is a view of FIG. 5 viewed from another angle illustrating an assembling relationship between the electrical connector and the circuit board in the first embodiment.

Referring to FIG. 1 to FIG. 3, the two fixing members 6 each allow the first ground piece 46 and the second ground piece 52 which are positioned at the same side to be fixed to and electrically connected to the corresponding ground pad 16. In the present embodiment, each fixing member 6 is a bolt which may pass through the through hole 463 cooperatively defined by the first ground piece 46 and the second ground piece 52 and the mounting hole 17 of the circuit board 1, may cooperate with a nut (not shown) to interpose and fix the first ground piece 46 and the second ground piece 52, which are positioned at the same side and the circuit board 1, together and may allow the first ground piece 46 and the second ground piece 52 to contact the corresponding ground pad 16 so as to establish an electrical connection.

By that the outer shielding member 5 covers the two openings 45 of the metal shell 4, electro-magnetic wave may be shielded from emitting out from the two openings 45 during high frequency transmission of the electrical connector 9, so as to prevent EMI from being produced. In addition, because the two first ground pieces 46 each are received the penetrating hole 521 of the corresponding second ground piece 52, it is convenient to fix both of the first ground piece 46 and the second ground piece 52 together to the corresponding ground pad 16 of the circuit board 1 by means of threaded connection, that is, the first ground piece 46 and the second ground piece 52 which are positioned at the same side may share a fixed position so as to reduce an occupied area on the circuit board 1, and provide a plurality of ground paths to attain better ground effect.

Referring to FIG. 14 to FIG. 18, an electrical connection device in a second embodiment of the present disclosure is substantively the same as the electrical connection device in the first embodiment, however, in the second embodiment, the first ground piece 46 and the second ground piece 52 which are positioned at the same side are together fixed to the corresponding ground pad 16 by soldering, and in the second embodiment, the circuit board 1 does not have any mounting hole 17. The first ground piece 46 and the second ground piece 52 establish an electrical connection with the corresponding ground pad 16 by a solder, and the solder may pass through the through hole 463 defined by the end edge 462 of the first ground piece 46 and the inner edge of the second ground piece 52, and cover the end edge 462 of the first ground piece 46 and the inner edge of the second ground piece 52 so as to increase soldering strength.

Referring to FIG. 19 to FIG. 22, an electrical connection device in a third embodiment of the present disclosure is substantively the same as the electrical connection device in the first embodiment substantively, however, in the third embodiment, the two penetrating holes 521 of the two second ground pieces 52 are respectively matched with the two first ground pieces 46, so as to allow the two first ground piece 46 to respectively fully fill the two penetrating holes 521, that is, each penetrating hole 521 fully receives the corresponding first ground piece 46. In addition, similar with that of the second embodiment, in the third embodiment, the first ground piece 46 and the second ground piece 52 which are positioned at the same side are together fixed to the corresponding ground pad 16 by soldering, so that the first ground piece 46 and the second ground piece 52 establish an electrical connection with the corresponding ground pad 16 by the solder.

In conclusion, by that the outer shielding member 5 covers the two openings 45 of the metal shell 4, EMI may be prevented from being produced during high frequency transmission of the electrical connector 9. In addition, because the two first ground pieces 46 each are received in the penetrating hole 521 of the corresponding second ground piece 52, it is convenient to fix the first ground piece 46 and the second ground piece 52 together to the corresponding ground pad 16 of the circuit board 1 by means of soldering connection or threaded connection, so that the first ground piece 46 and the second ground piece 52 establish an electrical connection with the corresponding ground pad 16, the first ground piece 46 and the second ground piece 52 may share the fixed position so as to reduce an occupied area on the circuit board 1, and provide a plurality of ground paths to attain better ground effect. Furthermore, the outer shielding member 5 may strengthen the whole structural strength of the electrical connection device, therefore the objects of the present disclosure are definitely attained.

However, what have been described above are only embodiments of the present disclosure, the implementation scope of the present disclosure is not limited to that, that is, simple equivalent variations and modifications made according to the Claims and the description content of the present disclosure are still included in the protective scope of the present disclosure.

What is claimed is:

1. An electrical connection device, comprising:

an electrical connector comprising:

an insulative body;

a plurality of conductive terminals provided to the insulative body;

a metal shell engaged with the insulative body and surrounding the insulative body, and having a top portion, two openings respectively formed at two sides of the top portion and two first ground pieces each positioned at a side of the corresponding opening and extending outwardly from the corresponding opening, the side of the corresponding opening being far away from the top portion; and an outer shielding member comprising a main body transversally provided on the top portion of the metal shell and covering the two openings and two second ground pieces respectively extending outwardly from two ends of the main body, the two second ground pieces each having a penetrating hole penetrating from a top surface to a bottom surface, at least a part of each penetrating hole of the two second ground pieces receiving the corresponding first ground piece.

2. The electrical connection device of claim 1, wherein each first ground piece has a pair of side edges spaced apart from each other, and the pair of side edges each are matched with a part of an inner edge of the corresponding second ground piece defining the penetrating hole in a manner of convex-concave.

3. The electrical connection device of claim 2, wherein each second ground piece has two stop portions positioned close to the main body respectively at two sides of the penetrating hole and protruding toward each other;

the two side edges of each first ground piece are recessed inwardly respectively in the positions corresponding to the two stop portions.

4. The electrical connection device of claim 1, wherein the main body of the outer shielding member has two position limiting portions respectively adjacent to the two penetrating holes and respectively positioned above the two corresponding first ground pieces.

5. The electrical connection device of claim 1, wherein each first ground piece has a pair of side edges spaced apart from each other and an end edge connecting the pair of side edges, the end edge of the first ground piece and a part of the inner edge of the corresponding second ground piece defining the penetrating hole cooperatively define a through hole.

6. The electrical connection device of claim 1, wherein the insulative body comprises a housing, a tongue extending forwardly from the housing, and two side walls respectively extending rearwardly from two sides of the housing, the plurality of conductive terminals are provided to the insulative body in arrangement of an upper row and a lower row, and each conductive terminal has a fixed portion fixed to the housing, a contact portion extending forwardly from the fixed portion to the tongue, and a resilient tail portion extending rearwardly from the fixed portion and extending out of the housing, the resilient tail portions of the conductive terminals in the two rows are positioned between the side walls.

7. The electrical connection device of claim 1, wherein the plurality of conductive terminals are provided to the insulative body in arrangement of an upper row and a lower row; and the electrical connector further comprises a ground metal piece provided to the insulative body and positioned between the conductive terminals in the upper row and the conductive terminals in the lower row, the ground metal piece comprises a body portion and at least a connecting portion, the connecting portion protrudes outwardly from the body portion, extends out of the insulative body and contacts the metal shell.

8. The electrical connection device of claim 1, wherein the electrical connection device further comprises a circuit board, the circuit board is provided with two ground pads;

the first ground piece and the second ground piece which are positioned at the same side are together fixed to and electrically connected to the corresponding ground pad.

9. The electrical connection device of claim 8, wherein the circuit board is further provided with two mounting holes respectively positioned within two regions where the two ground pads are respectively provided;

each first ground piece has a pair of side edges spaced apart from each other and an end edge connecting the pair of side edges, the end edge of the first ground piece and a part of the inner edge of the corresponding second ground piece defining the penetrating hole cooperatively define a through hole, the two through holes respectively correspond to the two mounting holes of the circuit board; and the electrical connection device further comprises two fixing members, each fixing member passes through the corresponding through hole and the corresponding mounting hole, fixes the corresponding first ground piece and the corresponding second ground piece to the circuit board, and allows the first ground piece and the second ground piece to contact the corresponding ground pad.

10. The electrical connection device of claim 8, wherein the first ground piece and the second ground piece which are positioned at the same side are together fixed to the corresponding ground pad by soldering.

11. The electrical connection device of claim 10, wherein each first ground piece has a pair of side edges spaced apart from each other and an end edge connecting the pair of side edges, the end edge of the first ground piece and a part of the inner edge of the corresponding second ground piece defining the penetrating hole cooperatively define a through hole.

12. The electrical connection device of claim 8, wherein the circuit board is further provided with a mounting groove formed between the two ground pads, and is further provided with a protruding portion protruding into the mounting groove, a plurality of conductive contact pieces correspondingly provided to an upper surface and a lower surface of the protruding portion, the electrical connector is provided in the mounting groove;

the insulative body comprises a housing, a tongue extending forwardly from the housing, and two side walls respectively extending rearwardly from two sides of the housing, the two side walls are positioned at two sides of the protruding portion;

the plurality of conductive terminals are provided to the insulative body in arrangement of an upper row and a lower row, and each conductive terminal has a fixed portion fixed to the housing, a contact portion extending forwardly from the fixed portion to the tongue, and a resilient tail portion extending rearwardly from the fixed portion and extending out of the housing, the resilient tail portions of the conductive terminals in the two rows are positioned between the side walls, the resilient tail portions of the conductive terminals in the upper row and the conductive terminals in the lower row respectively contact the conductive contact pieces on the upper surface of the protruding portion and the conductive contact pieces on the lower surface of the protruding portion so as to interpose the protruding portion therebetween.

13. The electrical connection device of claim 12, wherein the electrical connector further comprises a ground metal piece provided to the insulative body and positioned between the conductive terminals in the upper row and the conductive terminals in the lower row, the ground metal piece comprises a body portion and at least a connecting portion, the connecting portion protrudes outwardly from the body portion, extends out of the insulative body and contacts the metal shell.

14. The electrical connection device of claim 1, wherein the metal shell further comprises a bottom portion spaced apart from the top portion and two side portions each connecting the top portion and the bottom portion, the metal shell is formed by a metal plate and an engagement portion is formed in the top portion, and the two first ground pieces are respectively formed from the two side portions by stamping the two side portions.

15. The electrical connection device of claim 14, wherein the main body of the outer shielding member and the top portion of the metal shell are tightly connected by at least a laser joint.

16. The electrical connection device of claim 1, wherein the two first ground pieces are coplanar respectively with the two second ground pieces.

* * * * *